US007774987B2

(12) United States Patent
Pfeiffer

(10) Patent No.: US 7,774,987 B2
(45) Date of Patent: Aug. 17, 2010

(54) MOVABLE BUILDING

(75) Inventor: Heinz Pfeiffer, Immenstaad (DE)

(73) Assignee: EADS Deutschland GmbH, Ottobrunn (DE)

( * ) Notice: Subject to any disclaimer, the term of this patent is extended or adjusted under 35 U.S.C. 154(b) by 851 days.

(21) Appl. No.: 11/356,220

(22) Filed: Feb. 17, 2006

(65) Prior Publication Data

US 2010/0170162 A1 Jul. 8, 2010

(30) Foreign Application Priority Data

Mar. 9, 2005 (DE) ..... 10 2005 010 683

(51) Int. Cl.
*E04B 1/34* (2006.01)
*E04G 11/04* (2006.01)
*E04H 15/20* (2006.01)

(52) U.S. Cl. ..... 52/2.17; 52/2.18; 52/2.11; 52/2.19; 52/2.21; 52/118

(58) Field of Classification Search ..... 52/2.17, 52/2.18, 118, 2.21, 64, 2.11, 2.19
See application file for complete search history.

(56) References Cited

U.S. PATENT DOCUMENTS

| | | | | |
|---|---|---|---|---|
| 3,065,019 | A | 11/1962 | May | |
| 3,393,479 | A | 7/1968 | Slotnick | |
| 3,957,232 | A * | 5/1976 | Sebrell | 244/123.11 |
| 4,296,960 | A * | 10/1981 | Winchester | 296/167 |
| 5,226,261 | A * | 7/1993 | Wilbourn et al. | 52/2.21 |
| 5,478,129 | A * | 12/1995 | Goto et al. | 296/26.02 |
| 5,537,784 | A * | 7/1996 | Baldwin | 52/2.17 |
| 5,636,478 | A * | 6/1997 | Chen | 52/2.11 |
| 5,761,854 | A | 6/1998 | Johnson et al. | |
| 5,957,525 | A * | 9/1999 | Nelson | 296/165 |
| 6,029,404 | A * | 2/2000 | Lewis | 52/2.18 |
| 6,598,613 | B2 | 7/2003 | Fritzche et al. | |
| 6,749,252 | B2 * | 6/2004 | Cervenka | 296/165 |

FOREIGN PATENT DOCUMENTS

| | | |
|---|---|---|
| DE | 1455 862 | 8/1969 |
| EP | 1 229 188 A1 | 11/2001 |
| EP | 1 273 743 A1 | 1/2003 |
| GB | 898883 | 12/1959 |
| GB | 1104623 | 3/1965 |
| WO | WO 97/47831 | 12/1997 |

OTHER PUBLICATIONS

European Search Report dated Apr. 13, 2007 (Ten (10) pages).

* cited by examiner

*Primary Examiner*—Richard E Chilcot, Jr.
*Assistant Examiner*—Mark R Wendell
(74) *Attorney, Agent, or Firm*—Crowell & Moring LLP

(57) ABSTRACT

A mobile building module comprises rigid load-bearing surface elements and one or more inflatable flexible surface elements connected therewith. In the transport condition, several of the load-bearing rigid surface elements are disposed to form a parallelepiped container having a floor and surrounding rigid walls for accommodating the inflatable flexible surface elements, with the height of the container being lower than the height of the building. A building, which is assembled of several partial modules, which are constructed according to the above-mentioned principles, is also an object of the invention.

20 Claims, 7 Drawing Sheets

MOVABLE BUILDING

BACKGROUND AND SUMMARY OF THE INVENTION

This application claims the priority of German patent document 10 2005 010 683.8-25, filed Mar. 9, 2005, the disclosure of which is expressly incorporated by reference herein.

The invention relates to a mobile building and a building module, particularly for use as a military command post, a military hospital or an encampment.

Such mobile buildings are used world-wide, particularly by so-called military crisis reaction forces, and the need to transport them by aircraft and, in particular, to drop them from the air plays an increasingly important role.

Mobile buildings in the form of parallelepiped containers, preferably ISO Standard containers, with rigid load-carrying surface elements are known. For example, U.S. Pat. No. 5,761,854 discloses a container that includes lateral expansion elements in order to enlarge the width of its interior. In addition to rigid load-carrying surface elements, these expansion elements also have flexible surface elements made of textiles. Because of its weight and dimensions, this container is not suitable for dropping from the air.

European Patent Document EP 1 273 743 A1 discloses mobile buildings which consist completely of inflatable surface elements. These have a low weight and, to this extent, are well suitable for air transport. However, they require an additional transport container in which they can be safely stored, for transport and for the depositing from the air. Furthermore, equipment cannot be preinstalled in these buildings, but must be transported separately, and the time period for putting the building into operation is relatively long.

It is an object of the invention to provide a building which can be transported by air and dropped from the air, and which can be rapidly constructed and put into operation.

This and other objects and advantages are achieved by the building according to the invention, and partial modules thereof, which are very well adapted to the requirements of transportability by air and the capability to be dropped from the air. The building according to the invention includes significant parts which are made of flexible inflatable material (which parts naturally have a low weight) and rigid load-bearing surface elements. By means of its load-bearing surface elements, the building can be converted into a stable container housing for transport. The flexible surface elements of the building, (and in a particularly advantageous embodiment, preinstalled equipment) can be accommodated in the interior of the container housing that is thus formed. Additional transport containers are therefore not required.

The height of the container during the transport is lower than the height of the building itself, so that the container has small transport dimensions. This feature has an important advantage for transportation by air and for dropping from the air. Moreover, because of the inflatable surface element or elements, as well as the preintegration of equipment objects in the container, the building according to the invention can be put into operation very rapidly.

The mobile building can be transported by both cargo planes and helicopters, and can be dropped from the air by means of paradrops. For the land transport, a container can be equipped with wheels or can be placed on a truck or trailer, and because of the high inherent stability of the container, several can be stacked above one another for storage and for transport.

As mentioned above, a building can be constructed of several partial modules. These partial modules may be present as several types, particularly as end modules, center modules, coupling modules for connecting additional buildings.

Partial modules of the same type are preferably completely identical. Furthermore, regardless of the type of the partial modules, the containers have identical dimensions.

In one embodiment, a closed-off building consists of two end modules and one center module. The number of center modules can be increased arbitrarily in order to enlarge the length of the building. In addition, several such buildings can be connected with one another at a right angle by means of the above-mentioned coupling modules.

In a particularly advantageous embodiment, the partial modules have temporary flexible surface elements provided at the connection to the neighboring module, which flexible surface elements can be removed after the partial modules are coupled together. The rigid load-bearing surface elements together with the inflatable flexible surface elements as well as the temporary surface elements of a partial module form a shell which is completely closed off to the outside. This shell is already present in the transport condition and can also be maintained at all times during the construction. Only after the respective partial modules have been connected, will the temporary surface elements at the transition between the two partial modules be removed. This ensures that the interior of the building is completely protected at any point in time against the penetration of dirt, dust, etc., which is of considerable importance particularly when the building is used as a military hospital or laboratory.

Further advantages of the invention will become evident from the description and from the drawing. Exemplary embodiments of the invention are illustrated in a simplified form in the drawing and will be explained in more detail in the following description. In the drawing

DETAILED DESCRIPTION OF THE DRAWINGS

Figure 1A:
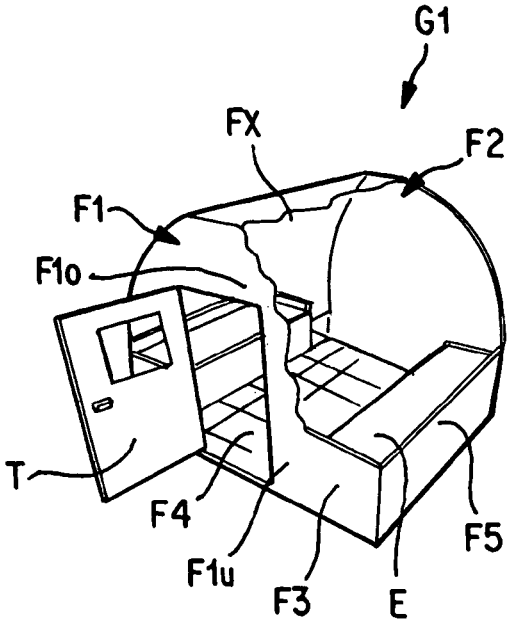
FIGS. 1*a* and 1*b* are views of a single-module building according to the invention in the operative condition, and in the transport condition, respectively.

FIG. 1*a* illustrates a building G1 according to the invention in the operative condition; that is, completely constructed. As shown, the building G1 comprises rigid load-bearing surface elements F1*u*, F3, F4, F5, which form the floor as well as the lower areas of the building walls. The upper areas of the building walls and the roof surfaces are essentially formed by an inflatable flexible surface element FX. At the two opposite end walls of the building G1, rigid load-bearing surface elements F1, F2 are provided which extend in sections to the entire height of the building. In the illustrated embodiment, of the rigid surface element F1 contains a door element T which provides the access. However, constructions are also possible in which both surface elements F1 and F2 each contain a door element.

The two surface elements F1, F2 on the ends are each divided into upper and lower parts F1*o* and F1*u*, which are rotatably connected to each other about a horizontal axis. The height of the lower part (F1*u*) of the inherently swivelable surface elements F1, F2 corresponds to the height of the container. The lower part F1*u* forms a portion of the board wall of the container in the transport condition. The upper part F1*o* forms a portion of the upper horizontal boundary surface of the container.

The described construction of the surface elements F1, F2, increases considerably the stability of the building, on the one hand. On the other hand, the entire surface of the inherently swivelable rigid surface element F1, F2 is utilized to form rigid surface elements of the container for the transport condition. Furthermore, the swivel ability of the surface element ensures fast assemble and disassembly of the building.

Figure 1B:
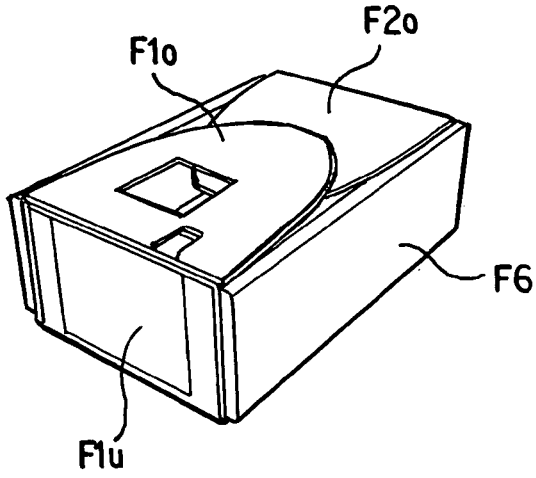

FIG. 1*b* shows the building in the transport condition in which it forms a parallelepiped-shaped container, the floor and the surrounding board wall being formed entirely of rigid load-bearing surface elements F1*u*, F4, F6 of the building. The longer board wall of the container comprises three rigid surface elements in three layers, of which FIG. 1*b* shows only the outermost surface element F6. The upper opening of the container is essentially covered by the two surface elements F1*o*, F2*o* folded upon one another, so that an additional protection of the container content is obtained by this covering. However, it should be noted that even a container which is open toward the top and is constructed of rigid load-bearing surface elements meets the requirements with respect to being dropped from the air. The inflatable flexible surface element FX of the building is situated in the interior of the container and is already largely connected with the rigid surface elements along corresponding edges. The equipment elements E, such as laboratory cabinets of the building are also situated inside the container.

The building according to the invention is unfolded and displayed from the container takes place as follows:

First, the upper parts F1*o*, F2*o* of the rigid surface elements F1, F2 at the two end walls are swiveled upward about the horizontal axis, which extends along the top edge of the board wall of the container. Then, the outer surface elements F6 of the longer board walls of the container are swiveled downward about a horizontal axis that extends along the bottom edge of the surface element F6, so that these outer surface elements F6 expand the floor. In the second layer of the longer board walls, two rigid load-bearing surface elements F3 are arranged which can each be swiveled about a vertical axis that extends along the vertical edges of the longer board walls F6. The length of the surface elements F3 is equal to the height of the board wall (F6) of the container. They are swiveled out so that they come to be situated in the plane of the two end walls of the building (thus, in the plane set by the surface elements F1, F2). The third, inner layer of a longer board wall is formed by a displaceable surface element F5 that extends over the entire length of the container. It is displaced parallel to the outside, in which case it can be guided on the already swiveled-out horizontal element F6 and vertical surface elements F3. The displaceable surface element F5 forms the lower area of a side wall of the building. The lower areas of the building walls as well as the floor are now formed by rigid load-bearing surface elements F1*u*, F3, F4 and F5 along the entire circumference of the building. The height of the surface elements F1*u*, F3, F4 and F5 corresponds to the height of the board walls of the container.

The flexible inflatable surface element FX is now inflated. It may consist, for example, of a plurality of chambers or hoses which can be filled individually. The construction of the building is now concluded and the equipment elements E can be positioned. In the present case, the laboratory cabinets are displaced toward the outside onto the walls of the building.

Figure 2:
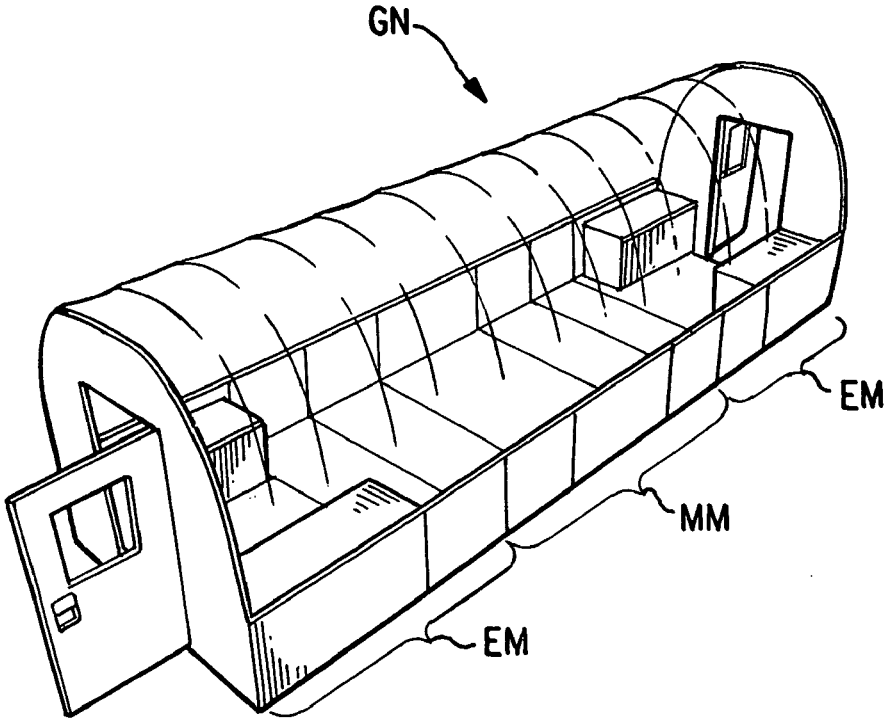
FIG. 2 shows a building according to the invention consisting of several partial modules.

FIG. 2 shows a building GN according to the invention which is assembled of several partial modules. In this embodiment, it consists of two end modules EM as well as one center module MM. The construction of the end module EM and the center module MM is illustrated in detail in FIGS. 4 and 5.

Figure 4A:
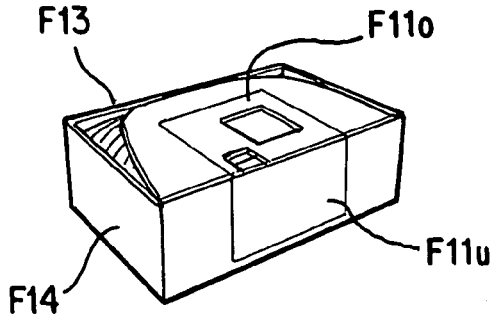
FIG. 4 is a view of a partial module constructed as an end module in the transport condition (FIG. 3*a*) and in several views in the operative condition (FIGS. 3*b, c*)
Figure 4B:
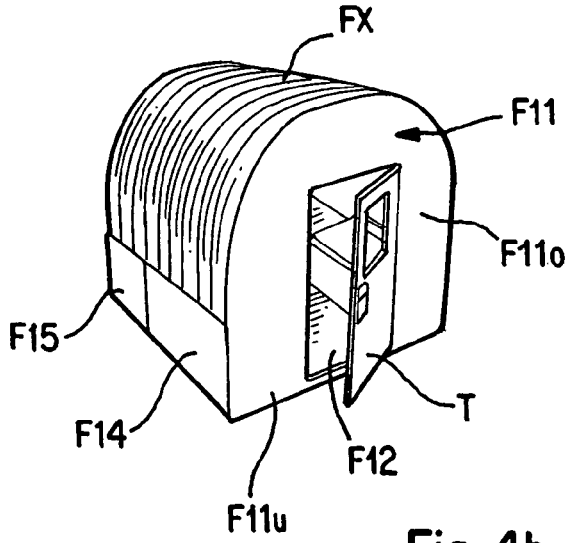
Figure 4C:
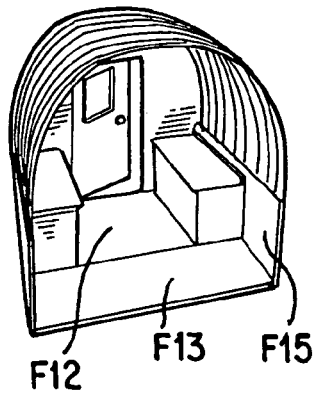

FIG. 4 shows an end module in the transport condition (FIG. 4*a*) as well as in the operative condition in two different views (FIG. 4*b*, 4*c*). One extremity of the end module has a rigid load-bearing surface element F11 in which a door element T is contained. In this embodiment, the rigid surface element F11 forms the entire end of the building. Similar to the embodiment of FIG. 1, the surface element F1*t* is divided into two parts, the upper F11*o* and lower part F11*u* being swivelably connected about a horizontal axis. Rigid load-bearing surface elements F12, F13, F14, F15 form the floor as well as the lower areas of the side walls. The upper areas of the side walls as well as the roof surfaces are formed by an inflatable flexible surface element FX.

The open extremity situated opposite the extremity with the door element T is provided for the connection of additional partial modules. In an advantageous embodiment, this opening can be closed off by means of a flexible temporary surface element which need not necessarily be inflatable. The connection of the temporary surface elements to the other rigid (F13, F14, F15) or inflatable (FX) surface elements takes place such that the different surface elements together form a shell which is completed closed off to the outside. When constructing a partial module, it is thereby ensured that no dirt or dust penetrates into the partial module from the outside. The partial module is now attached to the existing building (which by itself also forms a shell closed off to the outside), so that the resulting expanded building, as a whole, also forms a shell closed off to the outside. As soon as the partial module has been attached to the already existing building, the temporary surface elements present at the connection surface between the two neighboring modules can be removed. The use of the temporary surface elements, ensures that, when the entire building is assembled, no dirt, dust or other outside influences penetrate into the building.

Figure 3:
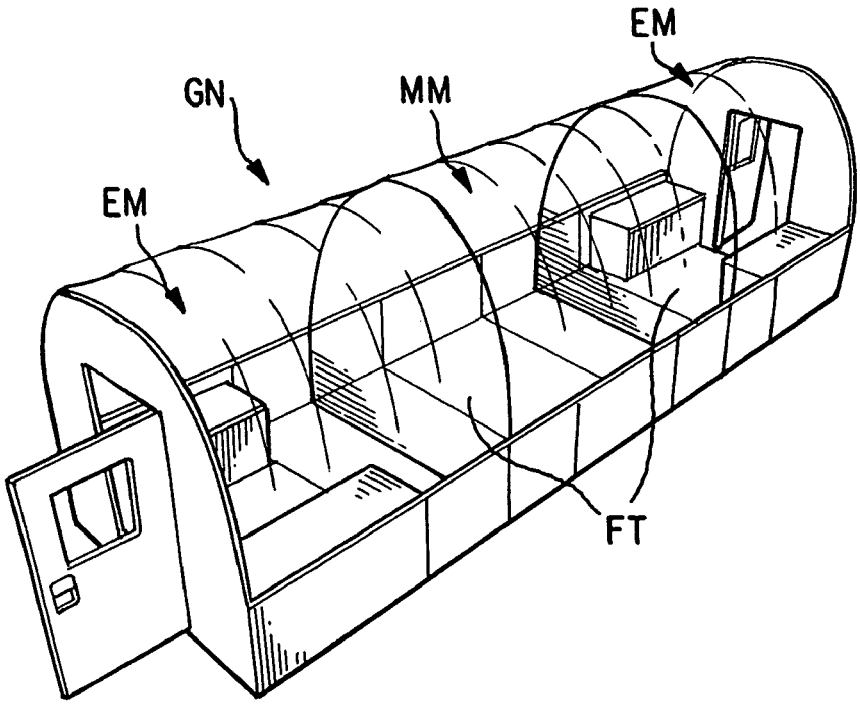
FIG. 3 shows the building of FIG. 2 with additional temporary surface elements at the connection surfaces for adjacent partial modules.

The principle of the use of temporary surface elements can be applied not only to the described end modules, but also to the connection surfaces of the other module types, as shown for example in FIGS. 5, 6 (discussed later). For this purpose, FIG. 3 shows a building GN consisting of three partial modules in whose interior the temporary surface elements FT are each present at the transition of two adjacent partial modules EM, MM.

In the transport condition, the partial module in FIG. 4 assumes the parallelepiped of the shape container, with a floor wall and a surrounding board wall consisting of rigid load-bearing surface elements F11*u*, F12, F14, F15. In essential parts, the upper opening of the container is covered by the folded-down upper part F11*o* of the surface element F11 of the end side. The inflatable flexible surface element FX of the building is situated in the interior of the container, and is connected with the rigid surface elements along their corresponding edges. Equipment elements E, such as laboratory cabinets for the building as well as additional equipment and apparatuses and devices, can also be situated inside the container.

The building in FIG. 4*a* is unfolded from the container as follows: First, on the end, the upper part F11*o* of the rigid surface element F11 is swiveled about the horizontal axis (which extends along the top edge of the board wall of the container) in the upward direction into a vertical position and is locked. The board wall of the opposite, open side of the partial module is constructed in two layers, FIG. 4*a* showing only the outer layer (surface element F13). Surface element F13 is now swiveled about a horizontal axis (which extends along the lower edge of the surface element F13) downward, so that it enlarges the floor. The second layer of this board wall is formed by two rigid load-bearing surface elements F15 (FIG. 4*b*) which can each be swiveled about a vertical axis (that extends along the vertical edges of the board wall). The length of these surface elements F15 is equal to the height of the board wall of the container. They are swiveled out by 90°, so that they are situated in the plane of one of the two shorter board walls F14 of the container and thus lengthen the latter. The flexible inflatable surface element FX is now inflated. The construction of the building has now been concluded.

Figure 5A:
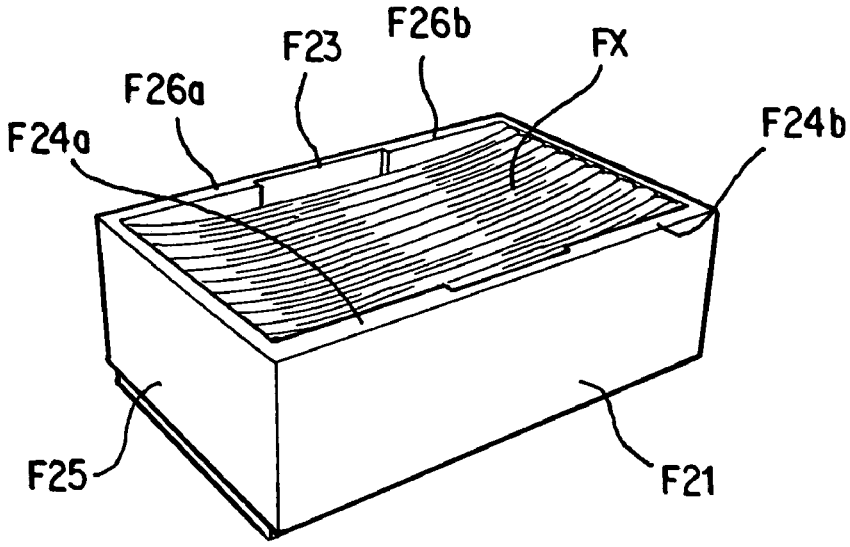
FIG. 5 is a view of a partial module constructed as a center module in the transport condition (FIG. 5*a*) and in the operative condition (FIG. 5*b*)
Figure 5B:
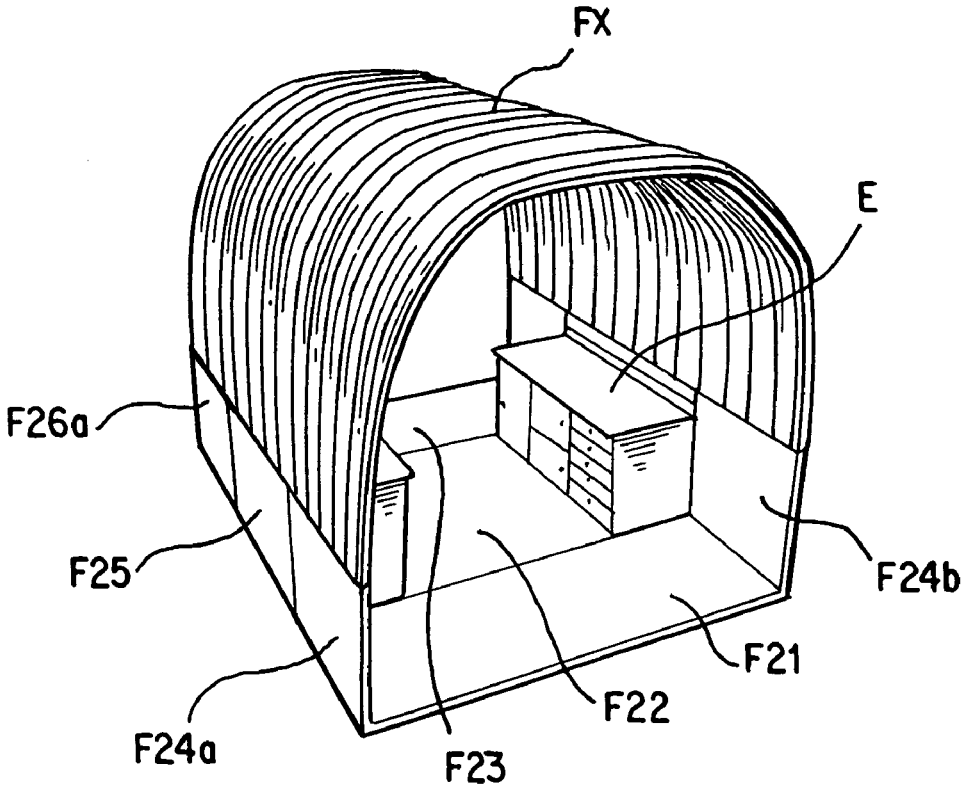

FIG. 5 shows a partial module constructed as a center module in the transport condition (FIG. 5*a*), and in the operative condition (FIG. 5*b*). Rigid load-bearing surface elements F21, F22, F23, F24*a*, F24*b*, F25, F26*a*, F26*b* form the floor as well as the lower areas of the side walls. The upper areas of the side walls as well as the roof surfaces are formed by the inflatable flexible surface element FX. The two ends of the module are open, and are intended for the connection of additional partial modules.

In the transport condition, this partial module assumes a parallelepiped container that is open in the upward direction, and has the floor F22 and the surrounding board wall consisting of rigid load-bearing surface elements F21, F23, F24*a*, F24*b*, F25, F26*a*, F26*b*. The flexible inflatable surface element FX as well as, as required, equipment elements E are stored on the inside. The two longer board walls are constructed in two layers. For the construction of the partial module, the outer surface elements F21, F23, which extend along the entire length of the board wall, are swiveled downward about a horizontal axis in order to expand the floor. In the second layer of the board wall, in each case, two additional rigid surface elements F24*a*, F24*b*; F26*a*, F26*b*, are situated. The letter can be swiveled about a vertical axis along the vertical edges of the board wall in order to lengthen the surface elements F25 of the shorter board wall. The length of the surface elements F24, F26 is identical with the height of the board wall.

When they are coupled to one another, two end modules EM according to FIG. 4 and one center module MM according to FIG. 5 together form a building GN according to FIG. 2. The lower areas of the building walls are formed by rigid load-bearing surface elements along the entire perimeter of the building GN. In this case, the height of the rigid load-bearing surface elements corresponds to the height of the board walls of the container in the transport condition. The height of these surface elements (and thus the height of the container) is advantageously selected to be large enough that it exceeds the normal working height of a working space; thus, for example, the height of a work table or of a lower cabinet in the case of laboratory equipment. As a result, it is ensured that such equipment objects (for example, lower laboratory cabinets, work tables, desks, etc.) can be transported in the container and can also be fixedly preinstalled therein. When the building is put into operation, these equipment objects do not have to be assembled or set up, The building according to the invention can therefore be put into operation very rapidly. The height of the vertical surface elements (identical to the height of the container in the transport condition) is preferably selected to be greater than 75 cm, particularly in the range of from 80 cm to 100 cm.

Figure 6A:
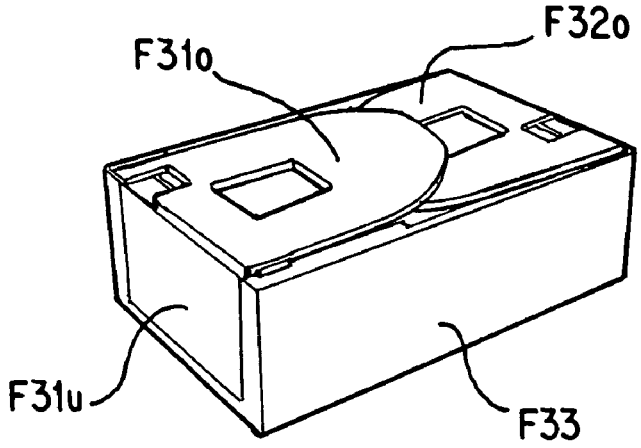
FIG. 6 is a view of a partial module constructed as a coupling module for the connection to other buildings in the transport condition (FIG. 6*a*) and in the operative condition (FIG. 6*b*)
Figure 6B:
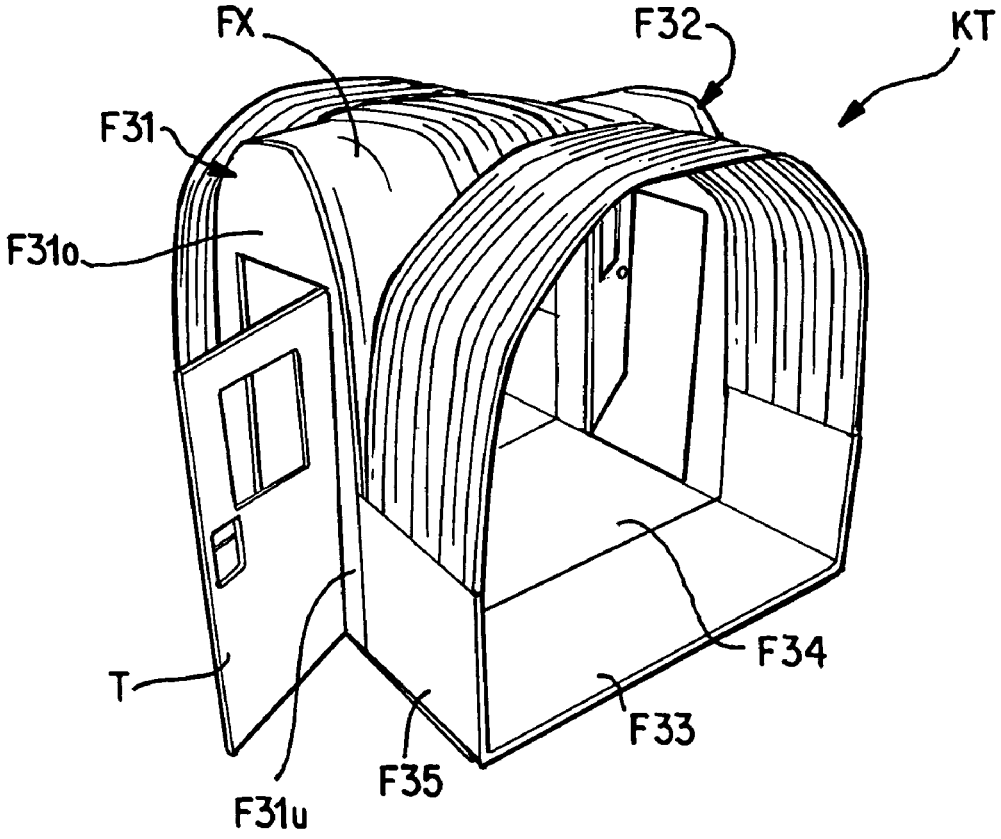

FIG. 6 illustrates another partial module for a mobile building according to the invention which can be used as a coupling module KM for the connection to additional buildings. Particularly with respect to the swiveling mechanisms of the rigid surface elements during unfolding from the transport condition, this partial module is very similar to the center module according to FIG. 5. Like the center module according to FIG. 5, it has two opposite open ends for the connection of additional partial modules (end modules, center modules, additional coupling modules) of the building. Also like a center module, the coupling module has rapid load-bearing surface elements for the floor (surface elements F33, F34) as well as for the lower areas of the side walls (surface elements F31*u*, F35).

In contrast to the center module, however, rigid load-bearing surface elements F31, F32 are provided at the two opposite side walls of the building on which the connection to the additional building takes place, which surface elements F31, F32 extend in sections to the entire height of the building. The surface elements F31, F32 contain particularly a door element T. The two surface elements F31, F32 are each divided into two upper parts F310 and lower parts F31*u* which can be swiveled about horizontal axes (at the level of the upper edge of the container board wall). The upper areas of the side walls as well as the roof surfaces are formed essentially of the inflatable flexible surface element FX.

In the transport condition, a container is again obtained which has a floor and a surrounding board wall, the container opening being covered in the upward direction now in essential areas by the upper parts F31*o*, F32*o* of the surface elements F31, F32. For constructing the coupling module, first the upper parts F31*o*, F32*o* are swiveled upward into a vertical position and locked. The further unfolding of the container is identical to the description according to FIG. 5 for a center part, to which reference is made. In this case, for example, surface element F35 corresponds to surface element 24*a* of FIG. 5 which can be swiveled about a horizontal axis. As in the case of the center part illustrated in FIG. 5, the board wall is constructed in two layers. However, the coupling modules can be used not only for the connection of two buildings, but also center modules within the building, whereby accesses can be implemented at the side walls of the building.

Figure 7:
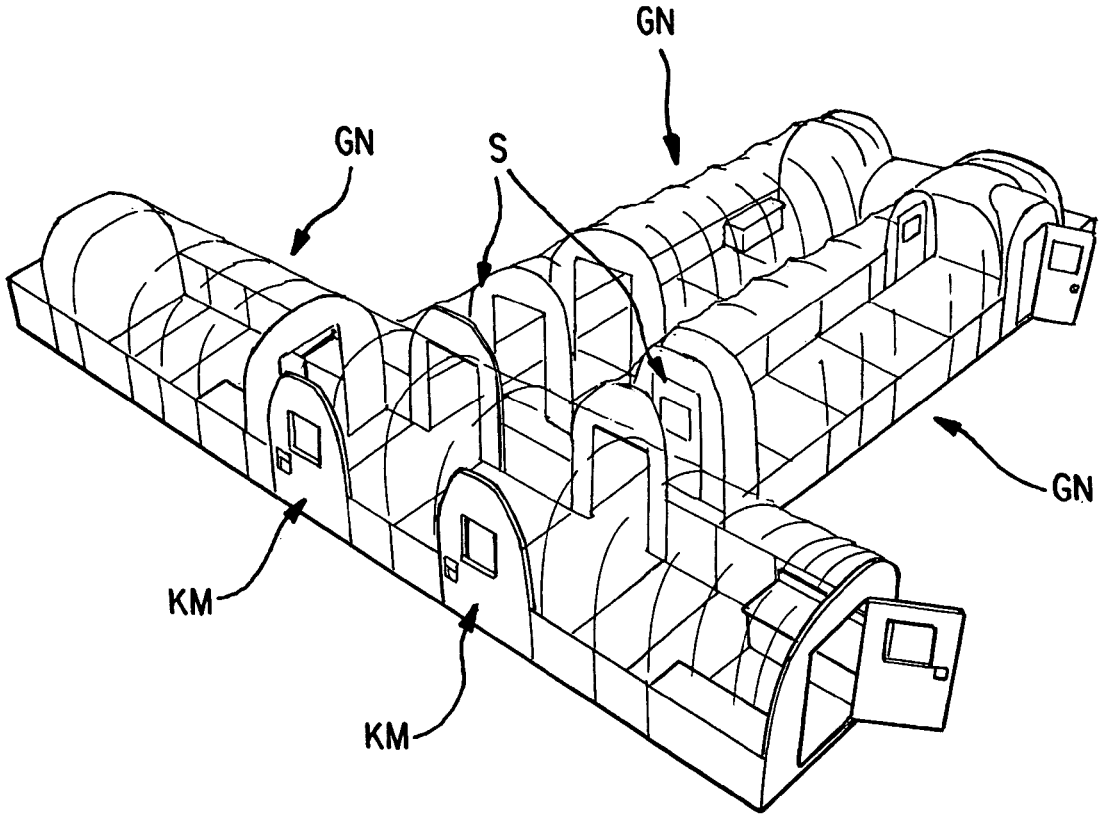
FIG. 7 is a view of several buildings according to the invention, which are connected with one another by means of coupling modules.

FIG. 7 shows three buildings GN according to the invention, two of the buildings being connected their ends to the side walls of the third building. Each of the mutually connected buildings GN comprises several partial modules according to FIGS. 4, 5 and possibly FIG. 6. The coupling of the buildings takes place by way of the coupling modules KM, an additional passage lock S advantageously existing between the buildings GN to be coupled. The lock S can advantageously be transported in one of the containers formed by the partial modules. Over the entire perimeter of the building GN, the lower areas of the building walls are formed by rigid load-bearing surface elements. The height of the surface elements corresponds to the height of the board walls of a container in the transport condition.

Figure 8A:
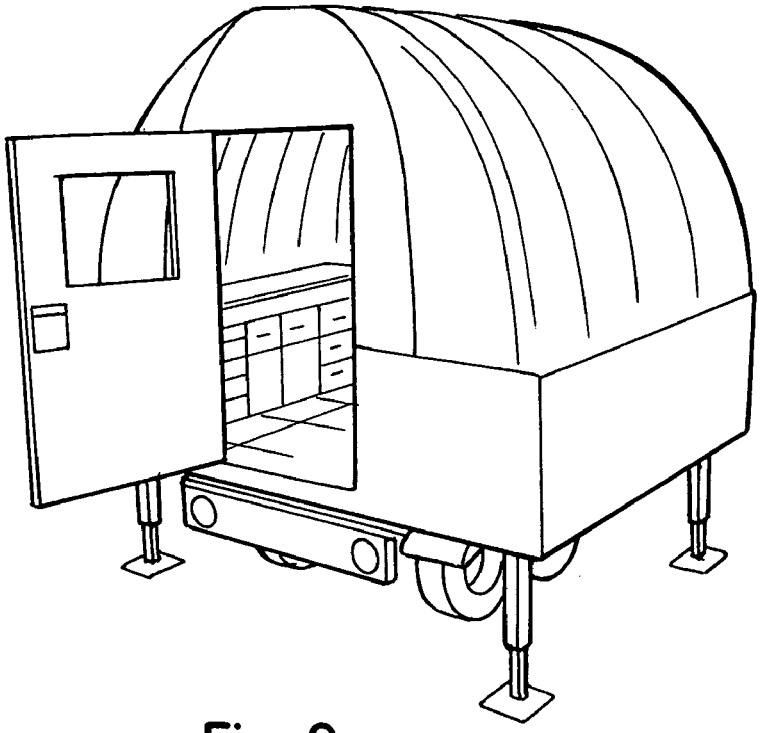
FIG. 8 is a view of the building of FIG. 1 according to the invention installed on a trailer in the operative condition (FIG. 8*a*) and in the transport condition (FIG. 8*b*).
Figure 8B:
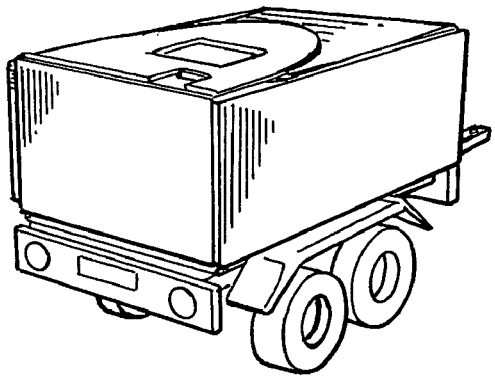

FIG. 8 illustrates a single-module building (corresponding to FIG. 1) according to the invention, which is installed on an off-road trailer. FIG. 8*a* shows the building in the operative condition; FIG. 8*b* shows it in the transport condition in which it is in the container shape.

If no corresponding vehicle is available after the air drop, as an alternative, individual wheels can also be mounted directly on the container.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A mobile building module that is transportable by, and separable from, a vehicle, said building module comprising:

rigid load-bearing surface elements; and at least one inflatable flexible surface element connected to at least some of the load bearing surface elements; wherein, in an assembled state of the building module, wherein said building module is separated from said vehicle, said at least one inflatable flexible surface element constitutes at least a roof of said building module;

in a transport condition of the building module, wherein said building module is loadable into or onto, and separable from, said vehicle, a plurality, of the load-bearing rigid surface elements are assembled so as to form a parallelepiped container having a floor and surrounding rigid walls for accommodating the inflatable flexible surface elements, said floor and rigid walls being separate from structural elements of said vehicle;

a height of the container is less than a height of the building module in said assembled state;

one surface element of said rigid load-bearing surface elements is situated on at least one side of said building module;

said one surface element comprises an upper part and a lower part, wherein said upper part can be swiveled with respect to said lower part, about a horizontal swivel axis;

in the assembled state of the building module, said upper part of said one surface element is swiveled upwardly about said horizontal swivel axis, so that it extends upward from said horizontal swivel axis, above said lower part, and so that said one surface element extends over an entire height of the assembled building module;

in said transport condition of said building module, said lower part forms at least a part of the wall of the container, and said upper part is swiveled about said horizontal swivel axis, to a horizontal position in which it forms at least part of an upper surface of the container;

a height of said lower part corresponds to the height of the container.

2. The mobile building module according to claim 1, wherein:

a floor and lower areas of walls of an assembled building module are formed by the floor and the walls of the parallelepiped container.

3. Mobile building module according to claim 2, wherein:

the walls of the container form the lower areas of the building walls over an entire height of the walls of the container.

4. The mobile building module according to claim 3, wherein:

the lower areas of the building walls are formed of the walls of the container over an entire area of the building.

5. The mobile building module according to claim 4, wherein:

upper areas of the building module walls as well and roof surfaces of the building module are formed by the inflatable flexible surface elements.

6. The mobile building module according to claim 5, wherein:

in the transport condition, equipment objects are contained within the parallelepiped container.

7. The building module according to claim 1, wherein a floor and at least one side wall of the parallelepiped container collectively form a continuous planar floor throughout the building module in the assembled state thereof.

8. The mobile building module according to claim 1, further comprising at least one rigid load bearing surface element that is swivelable about a horizontal axis along its lower edge, from a vertical position in said transport condition, into a horizontal position, forming a portion of said floor of said building module in said assembled state.

9. A mobile building comprising a plurality of individual building modules, wherein:

the individual modules each have rigid load-bearing surface elements and at least one inflatable surface element connected therewith;

in an assembled state of the building, said at least one inflatable surface element constitutes at least a roof of said building module;

in a transport condition of a module, a plurality of the load-bearing rigid surface elements of the module are assembled so as to form a parallelepiped container having a floor and surrounding walls for accommodating the inflatable flexible surface elements;

a height of the container is lower than the height of the building;

one surface element of said rigid load-bearing surface elements is situated on at least one side of said building;

said one surface element comprises an upper part and a lower part, wherein said upper part can be swiveled relative to said lower part, about a horizontal swivel axis;

in the assembled state of the building module, said upper part of said one surface element is swiveled upwardly about said horizontal swivel axis, so that it extends upward from said horizontal swivel axis, above said lower part, and so that said one surface element extends over an entire height of the assembled building module;

in said transport condition of said module, said lower part forms at least a part of the wall of the container of a module, and said upper part is swiveled about said horizontal swivel axis, to a horizontal position in which it forms at least part of an upper surface of the container;

a height of said lower part corresponds to the height of the container.

10. The mobile building according to claim 9, wherein:

a floor and lower areas of walls an assembled module are formed by the floor and the walls of the parallelepiped containers.

11. The mobile building a according to claim 10, wherein the walls of a container form the lower areas of the building walls over an entire height of the walls of the container.

12. The mobile building according to claim 11, wherein the lower areas of the building walls are formed of the walls of a container over an entire perimeter of the building.

13. The mobile building according to claim 12, wherein upper areas of the building walls and roof surfaces of the building are formed by the inflatable flexible surface elements of the partial modules.

14. The mobile building according to claim 13, wherein, in at least one of the partial modules in the transport condition, equipment objects are contained in the parallelepiped container.

15. The mobile building according to claim 9, wherein, at least one of the partial modules has temporary surface elements on openings at extremities thereof, for connection with a neighboring module; and said temporary surface elements are removable after coupling together of at least two individual modules.

16. The mobile building according to claim 15, wherein in the transport condition of an individual module, the rigid load-bearing surface elements together with the inflatable flexible surface elements and the temporary surface elements form a shell closed all around, which shell is maintained during construction of the partial module.

17. The mobile building claim 16, wherein, in the transport condition, the containers of the partial modules have identical edge lengths.

18. The mobile building according to claim 9, wherein a floor and at least one side wall of the parallelepiped container collectively form a continuous planar floor throughout each respective building module in the assembled state thereof.

19. A mobile building module that is transportable by, and separable from, a vehicle, said building module having an operational state in which elements of said module are separated from said vehicle, and are unfolded and assembled to form an enclosure that is delimited by a floor, side walls and a roof, and a transport state, in which at least some of said elements are folded in a manner that forms a rigid parallelepiped container that is loadable into or onto, and separable from, said vehicle, with remaining elements of said module being enclosed and protected, said building module comprising:

a plurality of load bearing surface elements which are separate from structural elements of said vehicle; and at least one flexible inflatable element connected to at least some of the load bearing surface elements; wherein, at least some of said load bearing surface elements comprise upper and lower portions that can be folded relative to each other along at least a horizontal swivel axis at which said upper and lower portions are rotatably joined to each other;

in said transport state, at least some of said load bearing surface elements are folded relative to each other so that said lower portions form side walls and said upper portions form an upper outer surface of said container, and said at least one flexible inflatable element is folded and enclosed inside said container;

in said operational state, said load bearing surface elements are unfolded upwardly about said horizontal swivel axis, with at least some of said unfolded load bearing surface elements forming side walls of said enclosure, and said at least one flexible inflatable element is inflated and forms said roof;

in said operational state, said upper portion of at least one of said load bearing surface elements extends upward from said swivel axis, above said lower portion, so that said at least one of said load bearing surface elements extends over an entire height of said building module; and together with said floor and side walls, the inflated flexible inflatable element delimits said enclosure, separating an interior of the enclosure from an exterior of the enclosure.

20. The mobile building module according to claim 19, wherein in said operational state, said inflated flexible inflatable element also forms at least an upper part of at least some of said side walls.

* * * * *